US005561031A

United States Patent [19]

Bowne

[11] Patent Number: 5,561,031

[45] Date of Patent: Oct. 1, 1996

[54] COLOR REVERSAL ELEMENTS WITH INCORPORATED BLEACH ACCELERATOR

[75] Inventor: Arlyce T. Bowne, Rochester, N.Y.

[73] Assignee: Eastman Kodak Company, Rochester, N.Y.

[21] Appl. No.: 411,353

[22] Filed: Mar. 23, 1995

[51] Int. Cl.[6] ..... G03C 5/50; G03C 7/305

[52] U.S. Cl. ..... 430/379; 430/505; 430/506; 430/543; 430/955

[58] Field of Search ..... 430/955, 543, 430/505, 506, 379

[56] References Cited

U.S. PATENT DOCUMENTS

| | | | |
|---|---|---|---|
| 4,269,923 | 5/1981 | Roosen et al. | 430/379 |
| 4,684,604 | 8/1987 | Harder | 430/446 |
| 4,842,994 | 6/1989 | Sakanoue et al. | 430/543 |
| 4,959,299 | 9/1990 | Sakanoue et al. | 430/544 |

FOREIGN PATENT DOCUMENTS

| | | | |
|---|---|---|---|
| 0295632 | 12/1988 | European Pat. Off. | G03C 7/32 |
| 0310125 | 4/1989 | European Pat. Off. | G03C 7/26 |
| 0348134 | 12/1989 | European Pat. Off. | G03C 7/32 |
| 0383623 | 8/1990 | European Pat. Off. | G03C 7/30 |
| 0193389 | 10/1990 | European Pat. Off. | G03C 7/32 |
| 0301477 | 4/1991 | European Pat. Off. | G03C 7/305 |
| 0570109 | 11/1993 | European Pat. Off. | 430/505 |
| 63/70239 | 3/1988 | Japan | G03C 1/02 |
| 63/70853 | 3/1988 | Japan | G03C 7/32 |
| 3070852 | 3/1988 | Japan | 430/505 |
| 1224755 | 9/1989 | Japan | 430/505 |

OTHER PUBLICATIONS

Japanese Abstract 3/144634 (Jun. 20, 1991), Konica Corp.
Japanese Abstract 1/253737 (Oct. 11, 1989), Konica Corp.
Japanese Abstract 2/235055 (Sep. 18, 1990), Fuji Photo Film KK.
Japanese Abstract 1/209447 (Aug. 23, 1989), Fuji Photo Film KK.
Japanese Abstract 1/207747 (Aug. 21, 1989), Fuji Photo Film KK.
Japanese Abstract 1/042650 (Feb. 14, 1989), Fuji Photo Film KK.
Japanese Abstract 63/121844 (May 25, 1988), Fuji Photo Film KK.
Japanese Abstract 63/121843 (May 25, 1988), Fuji Photo Film KK.
Japanese Abstract 63/106749 (May 11, 1988), Fuji Photo Film KK.
Japanese Abstract 62/168130 (Jul. 24, 1987), Konishiroku Photo KK.
Japanese Abstract 61/252552 (Nov. 10, 1986), Fuji Photo Film KK.
Japanese Abstract 2/110552 (Apr. 23, 1990), Konica Corp.
Japanese Abstract 2/093454 (Apr. 4, 1990), Fuji Photo Film KK.
Japanese Abstract 1/231049 (Sep. 14, 1989), Fuji Photo Film KK.
Japanese Abstract 1/224756 (Sep. 7, 1989), Fuji Photo Film KK.
Japanese Abstract 1/224755 (Sep. 7, 1989), Fuji Photo Film KK.
Japanese Abstract 1/219748 (Sep. 1, 1989), Fuji Photo Film KK.
Japanese Abstract 1/219745 (Sep. 1, 1989), Fuji Photo Film KK.
Japanese Abstract 1/219744 (Sep. 1, 1989), Fuji Photo Film KK.
Japanese Abstract 1/216353 (Aug. 20, 1989), Fuji Photo Film KK.
Japanese Abstract 1/214847 (Aug. 29, 1989), Fuji Photo Film KK.
Japanese Abstract 1/204048 (Aug. 16, 1989), Fuji Photo Film KK.
Japanese Abstract 1/202752 (Aug. 15, 1989), Fuji Photo Film KK.
Japanese Abstract 1/201658 (Aug. 14, 1989), Fuji Photo Film KK.
Japanese Abstract 63/301950 (Dec. 8, 1988), Konishiroku Photo KK.
Japanese Abstract 63/214752 (Sep. 7, 1988), Fuji Photo Film KK.
Japanese Abstract 63/175850 (Jul. 20, 1988), Konishiroku Photo KK.
Japanese Abstract 63/070854 (Mar. 31, 1988), Konishiroku Photo KK.
Japanese Abstract 63/070852 (Mar. 31, 1988), Konishiroku Photo KK.
Japanese Abstract 63/070851 (Mar. 31, 1988), Konishiroku Photo KK.
Japanese Abstract 62/135830 (Jun. 18, 1987), Fuji Photo Film KK.
J62/182739, Aug. 1987, Japan, English Translation—claims 1,2.
RD 308119, Dec. 1989.

*Primary Examiner*—Lee C. Wright
*Attorney, Agent, or Firm*—Gordon M. Stewart; Sarah Meeks Roberts

[57] ABSTRACT

A color reversal photographic element having a light sensitive silver halide emulsion layer, and a second layer containing a light insensitive silver halide emulsion. The element additionally has a bleach accelerating releasing compound in the second layer or in a layer associated therewith. A method of processing such elements is also provided.

14 Claims, No Drawings

COLOR REVERSAL ELEMENTS WITH INCORPORATED BLEACH ACCELERATOR

FIELD OF THE INVENTION

This invention relates to color reversal photographic elements containing particularly located bleach accelerating releasing compounds and non-imaging silver halide, as well as a method of processing such elements.

BACKGROUND OF THE INVENTION

Bleach Accelerator Releasing Compounds (BAR's) are known for use in color negative photographic elements to aid in the oxidation of silver in photographic systems, so that the resulting silver halide can be effectively removed from the element. The BAR is generally coated in the imaging layers of the film, and the accelerator fragment is either released directly from the compound upon reaction with oxidized developer, or is released from a linking group (which can include timing groups) which itself is released from the compound after reaction with oxidized developer.

In color negative systems the foregoing imagewise release of a bleach accelerator fragment is suitable to aid oxidation of the metallic silver which is also generated imagewise in the element. However, reversal films are first processed by contact with a non-chromogenic developer (that is, a developer which does not cause the formation of colored dyes) to develop exposed silver halide, followed by a fogging treatment of remaining silver halide, followed by treatment with a color developer. Thus, in reversal films, unlike color negative films, silver is generated throughout the image in both regions of maximum image dye density ("dye Dmax") and regions of minimum image dye density ("dye Dmin"). When a BAR is placed directly in an imaging layer or in a non-silver containing interlayer of a reversal film, bleach acceleration in the low exposure regions (dye Dmax regions) is aided, while bleaching remains slow in the high exposure regions (dye Dmin regions). As already discussed, this situation is unsatisfactory in that in a color reversal element silver should be bleached fairly consistently throughout the element. Retained silver in the Dmin regions is particularly objectionable for reversal elements. Sensitometry and image structure a can also be adversely affected by the presence of a BAR in the imaging layers.

It would be desirable then, to have a color reversal element with a BAR which can uniformly assist in silver bleaching throughout the element.

SUMMARY OF THE INVENTION

The present invention then, provides a color reversal photographic element comprising a light sensitive silver halide emulsion layer, and a second layer containing a light insensitive silver halide emulsion. The element additionally comprises a bleach accelerating releasing compound in the second layer or in a layer associated therewith. The present invention also provides a method of processing such color reversal elements.

Color reversal elements of the present invention have bleach acceleration provided in the element in a manner which is not dependent on the exposure of different areas of the element. Additionally, with the BAR being present in association with a layer containing light-insensitive silver halide (that is, a layer which will not produce a dye image), sensitometry and image structure of the element is not adversely affected in the same manner as may be the case with a BAR in a light sensitive silver halide layer.

EMBODIMENTS OF THE INVENTION

In the present application, reference to "under", o "above", "below", "upper", "lower" or the like terms in relation to layer structure of a photographic element, is meant the relative position in relation to light when the element is exposed in a normal manner. "Above" or "upper" would mean closer to the light source when the element is exposed normally, while "below" or "lower" would mean further from the light source. Since a typical photographic element has the various layers coated on a support, "above" or "upper" would mean further from the support, while "below" or In "under" would mean closer to the support. Further, reference to any chemical "group" (such as alkyl group, aryl group, heteroaryl group, and the like) includes the possibility of it being both substituted or unsubstituted (for example, alkyl group and aryl group include substituted and unsubstituted alkyl and substituted and unsubstituted aryl, respectively). Generally, unless otherwise specifically stated, substituent groups usable on molecules herein include any groups, whether substituted or unsubstituted, which do not destroy properties necessary for the photographic utility. It will also be understood throughout this application that reference to a compound of a particular general formula includes those compounds of other more specific formula which specific formula falls within the general formula definition.

By "light insensitive silver halide" is meant that, in its location in the element, the silver halide exhibits less than 10% (preferably less than 5% or even 1%) of the sensitivity of any silver halide responsible for image formation in the element. In particular, in a conventional color reversal film having red sensitive, green sensitive and blue sensitive silver halide emulsion layers respectively containing a cyan coupler, a magenta coupler and a yellow coupler, the light insensitive silver halide exhibits, in its location in the element, less than 10% of the sensitivity of the silver halide emulsions responsible for image formation in those red, green and blue sensitive layers. Such light insensitive silver halide may or may not be chemically or spectrally sensitized, and may or may not be the same type and/or size as the imaging silver halide.

For example, where the blue sensitive silver halide is the uppermost light sensitive layer in the element, the light insensitive silver halide may be the same as the blue sensitive silver halide (and spectrally and chemically sensitized in the same way), but is light insensitive in the element because it is positioned in the same or lower layer as a blue absorbing material. Similarly, a green or red sensitized silver halide could be used as a light insensitive silver halide if positioned in or beneath a green or red absorbing material, respectively.

A light insensitive silver halide emulsion will normally be a fine grain silver halide emulsion having at least 50% of the particles with a size greater than 0.05 micron and preferably more than 0.1 microns. Generally, when the iodide concentration or the chemical and/or spectral sensitization of the light insensitive silver halide is higher, the silver halide particles will preferably tend to be smaller. Desensitizers on the light insensitive silver halide will allow the use of larger grains. The light insensitive silver halide will of course not be pre-fogged (that is, not fogged until reversal processing).

Silver halide color reversal films are typically associated with an indication for processing by a color reversal process.

Reference to a film being associated with an indication for processing by a color reversal process, most typically means the film, its container, or packaging (which includes printed inserts provided with the film), will have an indication on it that the film should be processed by a color reversal process. The indication may, for example, be simply a printed statement stating that the film is a "reversal film" or that it should be processed by a color reversal process, or simply a reference to a known color reversal process such as "Process E-6". A "color reversal" process in this context is one employing treatment with a non-chromogenic developer (that is, a developer which will not imagewise produce color by reaction with other compounds in the film; sometimes referenced as a "black and white developer"). This is followed by fogging unexposed silver halide, usually either chemically or by exposure to light. Then the element is treated with a color developer (that is, a developer which will produce color in an imagewise manner upon reaction with other compounds in the film).

In a typical construction, a reversal film does not have any masking couplers. Furthermore, reversal films have a gamma generally between 1.5 and 2.0, and this is much higher than for typical negative materials.

it is believed that the present invention functions because the non-imaging silver halide does not form a latent image during normal exposure of the element ("normal exposure" being an exposure sufficient such that in non-chromogenic development in a standard reversal process, an image is developed in imaging layers). During the fogging step in the reversal process, the non-light sensitive silver halide is then uniformly rendered developable. When the element is treated with color developer, oxidized color developer is then produced uniformly throughout the layer containing the non-light sensitive silver halide (that is, the oxidized color developer is produced in that layer in a manner which is not dependent on exposure). Thus, the bleach accelerating releasing compound will release a bleach accelerator substantially uniformly throughout the layer in which the compound is positioned. The bleach accelerator then diffuses to other layers to accelerate bleaching in a manner which will ideally be substantially independent exposure of the element. It will be appreciated though, that the layer containing the light insensitive silver halide should be located so that no subtantial amount of oxidized color developer will diffuse from the light insensitive silver halide layers to light sensitive silver halide imaging layers. Therefore, it is preferred to have an interlayer between the layer containing the light sensitive silver halide and the layer containing the light insensitive silver halide. Most preferably such an interlayer contains an oxidized developer scavenger. However, oxidized color developer received in the layer containing the bleach accelerating releasing compound from imaging layers, will not substantially affect the operation of the invention.

It will be seen from the foregoing description that it is only necessary that the bleach accelerating compound is located in a layer "associated" with the second layer (the layer containing the non-light sensitive silver halide). By "associated" then, means that the bleach accelerating compound is sufficiently close to the non-light sensitive silver halide containing layer so as to be able to react with oxidized color developer therefrom.

Preferably, the color reversal photograhic elements of the present invention has a support and the second layer (which, as described above, contains the light insensitive silver halide emulsion) is positioned beneath all light sensitive silver halide emulsion layers. The bleach accelerating releasing compound is preferably located in the second layer or a layer adjacent to the second layer (that is, there are no intervening layers). However, most preferably the bleach accelerating releasing compound is in the second layer. Hence, the release of bleach accelerator is more efficiently produced and able to diffuse to various parts of the element.

Preferably the color reversal elements of the present invention additionally comprise an antihalation layer (which is normally a fine grain silver and/or absorber dye containing layer). In such an element the second layer may be positioned above or below the antihalation dye layer, or may be the same layer as the antihalation dye layer.

As to the bleach accelerating releasing compound, such compounds are very well known. These compounds by be generally represented by the formula (I):

$$CAR\text{—}(LINK)_n\text{—}BA \qquad (I)$$

in which: CAR represents a carrier moiety which can react with oxidized primary amine developer to release —$(LINK)_n$—BA; n is 0 or a positive integer (preferably 0, 1, 2 or 3); LINK is a group which releases —BA upon further reaction or simply after a period of time; and BA is a bleach accelerator which enhances the bleaching rate of silver during processing of the element.

Bleach accelerating releasing compounds suitable for the present invention are typically classified as: coupler compounds which releases the bleach accelerator (which will be understood in this context to include the attached LINK, if any) upon coupling with oxidized aromatic amine developer; redox compounds which release the bleach accelerator upon a redox reaction between the compound (specifically, CAR) and an oxidized primary amine aromatic developer (not an oxidized non-chromogenic developer).

In the case of coupler compounds of formula (I), they will preferably either form a colorless compound upon coupling with oxidized aromatic amine developer, or form a compound at least 75% (and more preferably 80% or even 90 or 95%) of which is removed during standard reversal processing. By "standard reversal processing" in this application is meant Kodak Process E-6 for processing reversal films, as described in *British Journal of Photograph Annual* 1988, page 94–96 (the process referenced herein being the normal process without modifications), which is incorporated herein by reference. Coupler compounds of formula (I), should be sufficiently ballasted so as to stay in reactive association with the light insensitive silver halide described. The ballast would typically be on the LINK where the product of coupling between the compound and oxidized developer is to be removed during processing. On the other hand, if the product of coupling is colorless, the ballast group can be on LINK or CAR. Suitable bleach accelerating compounds are described in detail in the following U.S. Pat. No. 5,358,828; U.S. Pat. No. 5,318,879; U.S. Pat. No. 5,300,406; and U.S. Pat. No. 5,286,859. These patents and all other patents or references cited in this application, are incorporated in their entirety herein by reference.

In the case of redox release compounds of formula (I), such compounds preferably have a hydrazide moiety for CAR. Suitable compounds are described in detail in U.S. Pat. No. 4,684,604.

The present invention, as mentioned, also provides a method for processing color reversal elements of the invention. The method comprises contacting the element with a non-chromogenic developer to develop exposed silver halide, then fogging unexposed silver halide (usually by a light exposure or chemical fogging), then contacting the element with a color developer.

Examples of suitable bleach accelerating compounds are given below:
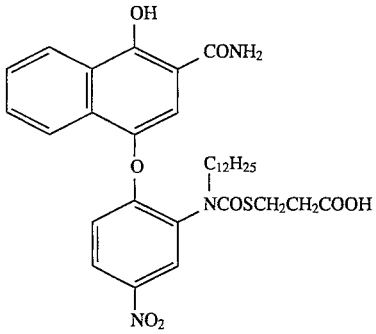
BAR-1
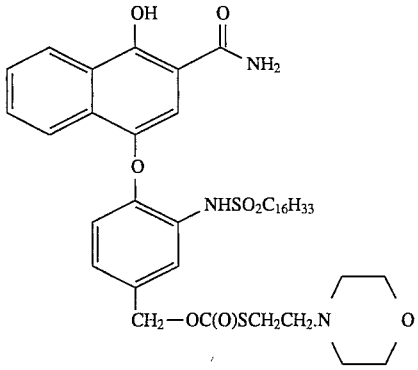
BAR-2
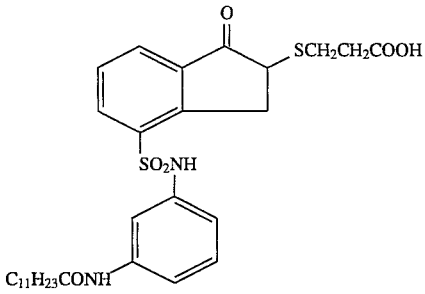
BAR-3
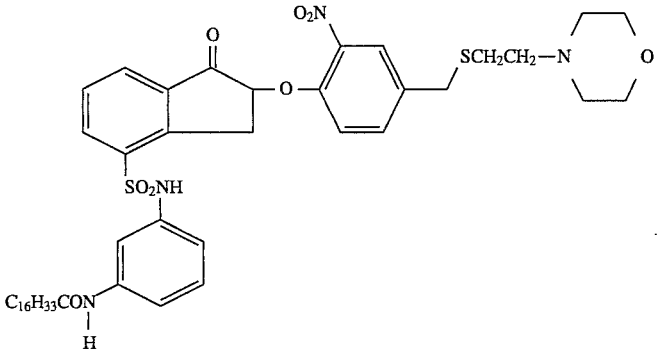
BAR-4
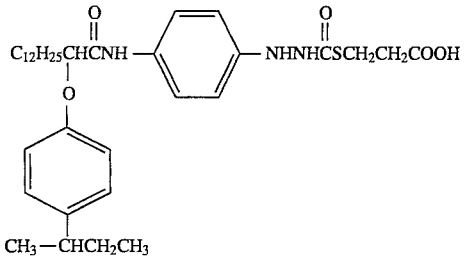
BAR-5
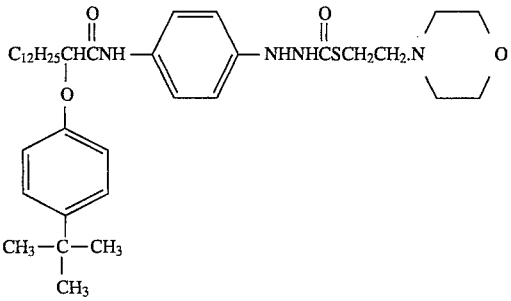
BAR-6
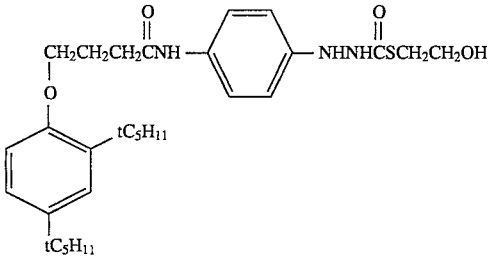
BAR-7
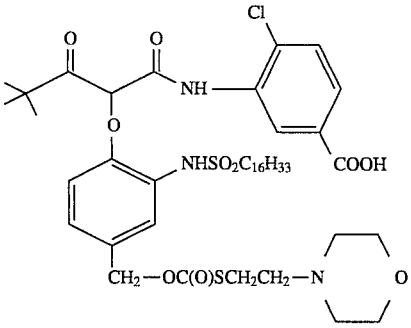
BAR-8

-continued

BAR-9

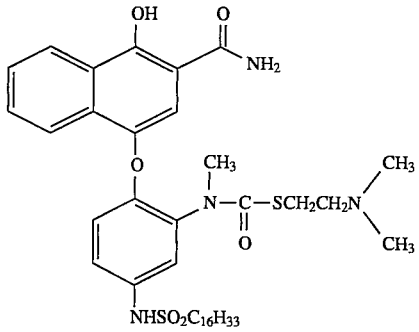

BAR-10

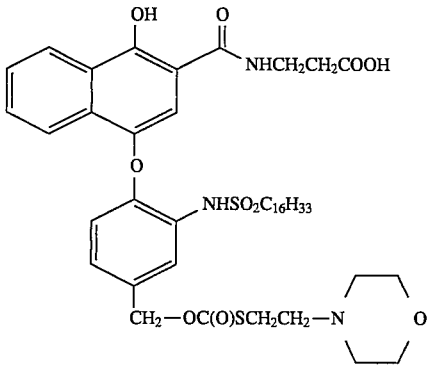

BAR-11

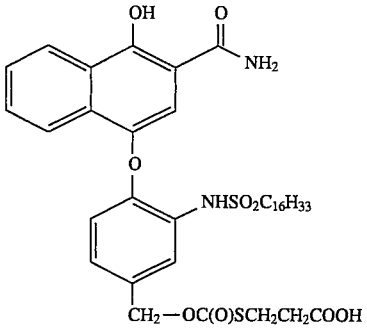

BAR-12

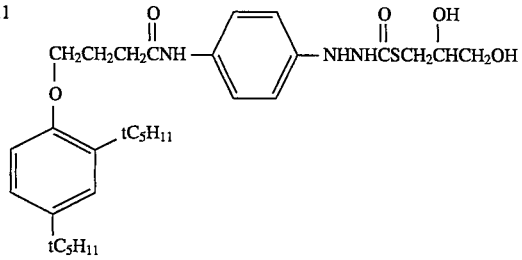

BAR-13

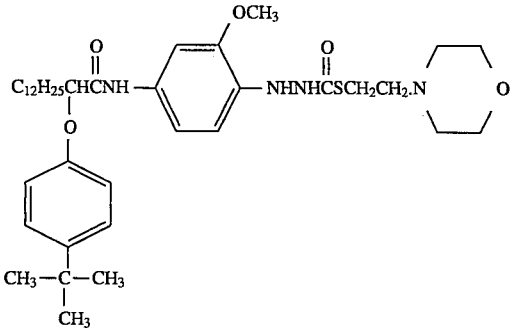

BAR-14

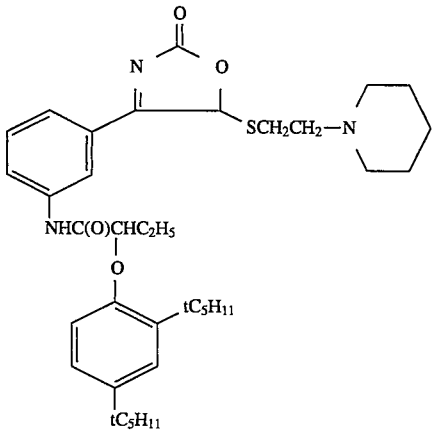

BAR-15

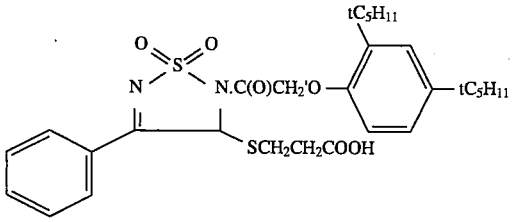

Photographic elements according to the present invention will typically have at least one light sensitive silver halide emulsion layer and a support, as already described.

Photographic elements of the present invention can be single color elements but are preferably multicolor elements. Multicolor elements contain dye image-forming units sensitive to each of the three primary regions of the spectrum. Each unit can be comprised of a single emulsion layer or of multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer.

A typical multicolor photographic element of the present invention comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, overcoat layers, subbing layers, and the like. All of these can be coated on a support which can be transparent or reflective (for example, a paper support). Photographic elements of the present invention may also usefully include a magnetic recording material as described in *Research Disclosure*, Item 34390, November 1992, or a transparent magnetic recording layer such as a layer containing magnetic particles on the underside of a transparent support as in U.S. Pat. No. 4,279,945 and U.S. Pat. No. 4,302,523. The element typically will have a total thickness (excluding the support) of from 5 to 30 microns. While the order of the color sensitive layers can be varied, they will normally be red-sensitive, green-sensitive and bluesensitive, in that order on a transparent support, with the reverse order on a reflective support being typical.

Photographic elements of the present invention can be used in conventional cameras including what are often referred to as single use cameras (or "film with lens" units). These cameras are sold with film preloaded in them and the entire camera is returned to a processor with the exposed film remaining inside the camera. Such cameras may have glass or plastic lenses through which the photographic element is exposed. However, the color reversal elements of the present invention can also be used by exposing in an electronic film writer (such film writers typically expose the film by laser, laser diode, or some other controlled light source).

In the following discussion of suitable materials for use in elements of this invention, reference will be made to *Research Disclosure*, September 1994, Number 365, Item 36544, published by Kenneth Mason Publications, Ltd., *Dudley Annex*, 12a North Street, Emsworth, Hampshire P010 7DQ, ENGLAND, which will be identified hereafter by the term "*Research Disclosure I*." The Sections hereafter referred to are Sections of the Research Disclosure I.

The light sensitive or light insensitive silver halide emulsions employed in the elements of this invention are negative-working, such as surface-sensitive emulsions or unfogged internal latent image forming emulsions. Suitable emulsions and their preparation as well as methods of chemical and spectral sensitization are described in Sections I through V. Color materials and development modifiers are described in Sections V through XX. Vehicles which can be used in the elements of the present invention are described in Section II, and various additives such as brighteners, antifoggants, stabilizers, light absorbing and scattering materials, hardeners, coating aids, plasticizers, lubricants and matting agents are described, for example, in Sections VI through X and XI through XIV. Manufacturing methods are described in all of the sections, other layers in Sections XI and XIV, processing methods and agents in Sections XIX and XX (although the present invention requires reversal processing of the element, as already defined above), and exposure alternatives in Section XVI.

Supports for photographic elements of the present invention include polymeric films such as cellulose esters (for example, cellulose triacetate and diacetate) and polyesters of dibasic aromatic carboxylic acids with divalent alcohols (for example, poly(ethylene-terephthalate), poly(ethylene-napthalates)), paper and polymer coated paper. Such supports are described in further detail in *Research Disclosure I*, Section XV.

The photographic elements may also contain additional materials that accelerate or otherwise modify the processing steps of bleaching or fixing to improve the quality of the image. Bleach accelerators described in EP 193,389; EP 301,477; U.S. Pat. No. 4,163,669; U.S. Pat. No. 4,865,956; and U.S. Pat. No. 4,923,784 are particularly useful. Also contemplated is the use of nucleating agents, development accelerators or their precursors (UK Patent 2,097,140; U.K. Patent 2,131,188); electron transfer agents (U.S. Pat. No. 4,859,578; U.S. Pat. No. 4,912,025); antifogging and anti color-mixing agents such as derivatives of hydroquinones, aminophenols, amines, gallic acid; catechol; ascorbic acid; hydrazides; sulfonamidophenols; and non color-forming couplers.

The elements may also contain filter dye layers comprising colloidal silver sol or yellow and/or magenta filter dyes, either as oil-in-water dispersions, latex dispersions or as solid particle dispersions. Additionally, they may be used with "smearing" couplers (e.g. as described in U.S. Pat. No. 4,366,237; EP 96,570; U.S. Pat. No. 4,420,556; and U.S. Pat. No. 4,543,323.) Also, the couplers may be blocked or coated in protected form as described, for example, in Japanese Application 61/258,249 or U.S. Pat. No. 5,019,492.

The photographic elements may further contain other image-modifying compounds such as "Developer Inhibitor-Releasing" compounds (DIR's). DIR compounds are disclosed, for example, in "Developer-Inhibitor-Releasing (DIR) Couplers for Color Photography," C. R. Barr, J. R. Thirtle and P. W. Vittum in *Photographic Science and Engineering*, Vol. 13, p. 174 (1969), incorporated herein by reference. DIRs that have particular application in color reversal elements are disclosed in allowed U.S. patent applications Ser. No. 08/004,019, 08/005,319, 08/005,472, and 08/007,440.

It is also contemplated that the concepts of the present invention may be employed to obtain reflection color prints. The emulsions and materials to form elements of the present invention, may be coated on pH adjusted support as described in U.S. Pat. No. 4,917,994; with epoxy solvents (EP 0 164 961); with additional stabilizers (as described, for example, in U.S. Pat. No. 4,346,165; U.S. Pat. No. 4,540,653 and U.S. Pat. No. 4,906,559); with ballasted chelating agents such as those in U.S. Pat. No. 4,994,359 to reduce sensitivity to polyvalent cations such as calcium; and with stain reducing compounds such as described in U.S. Pat. No. 5,068,171 and U.S. Pat. No. 5,096,805. Other compounds useful in the elements of the invention are disclosed in Japanese Published Applications 83-09,959; 83-62,586; 90-072,629, 90-072,630; 90-072,632; 90-072,633; 90-072,634; 90-077,822; 90-078,229; 90-078 230; 90-079,336; 90-079,338; 90-079,690; 90-079 691; 90-080,487; 90-080,489; 90-080,490; 90-080 491; 90-080,492; 90-080,494; 90-085,928; 90-086 669; 90-086,670; 90-087,361; 90-087,362; 90-087 363; 90-087,364; 90-088,096; 90-088,097; 90-093 662; 90-093,663; 90-093,664; 90-093,665; 90-093 666; 90-093,668; 90-094,055; 90-094,056; 90-101 937; 90-103,409; 90-151,577.

The silver halide used as the light sensitive or light insensitive silver halide in the photographic elements of the present invention, may be any of those types as described below. However, the light insensitive silver halide must in any event meet the light sensitivity limitations described above.

The silver halide may be silver iodobromide, silver bromide, silver chloride, silver chlorobromide, silver chloroiodobromide, and the like. This includes the possibility of the silver halide, specifically silver bromoiodide, containing at least 80% silver bromide or more (for example, at least 85%, 90%, 95% or 98% silver bromide). Iodide in the resulting emulsion will typically be no more than about 15% and preferably less than 9% (the remainder being silver bromide). The foregoing % figures are mole %.

The type of silver halide grains preferably include polymorphic, cubic, octahedral and tabular. The grain size of the silver halide may have any distribution known to be useful in photographic compositions, and may be ether polydipersed or monodispersed.

Particularly useful in the present invention are tabular grain silver halide emulsions. Tabular grains are those with two parallel major faces each clearly larger than any remaining grain face and tabular grain emulsions are those in which the tabular grains account for at least 30 percent, more typically at least 50 percent, preferably >70 percent and optimally >90 percent of total grain projected area. The tabular grains can account for substantially all (>97 percent) of total grain projected area. The tabular grain emulsions can be high aspect ratio tabular grain emulsions—i.e., ECD/t >8, where ECD is the diameter of a circle having an area equal to grain projected area and t is tabular grain thickness; intermediate aspect ratio tabular grain emulsions—i.e., ECD/t=5 to 8; or low aspect ratio tabular grain emulsions—i.e., ECD/t=2 to 5. The emulsions typically exhibit high tabularity (T), where T (i.e., $ECD/t^2$) >25 and ECD and t are both measured in micrometers (μm). The tabular grains can be of any thickness compatible with achieving an aim average aspect ratio and/or average tabularity of the tabular grain emulsion. Preferably the tabular grains satisfying projected area requirements are those having thicknesses of <0.3 μm, thin (<0.2 μm) tabular grains being specifically preferred and ultrathin (<0.07 μm) tabular grains being contemplated for maximum tabular grain performance enhancements. When the native blue absorption of iodohalide tabular grains is relied upon for blue speed, thicker tabular grains, typically up to 0.5 μm in thickness, are contemplated.

High iodide tabular grain emulsions are illustrated by House U.S. Pat. No. 4,490,458, Maskasky U.S. Pat. No. 4,459,353 and Yagi et al EPO 0 410 410.

Tabular grains formed of silver halide(s) that form a face centered cubic (rock salt type) crystal Lattice structure can have either {100} or {111} major faces. Emulsions containing {111} major face tabular grains, including those with controlled grain dispersities, halide distributions, twin plane spacing, edge structures and grain dislocations as well as adsorbed {111} grain face stabilizers, are illustrated in those references cited in *Research Disclosure I*, Section I. B. (3) (page 503).

The silver halide grains to be used in the invention may be prepared according to methods known in the art, such as those described in *Research Disclosure I* and James, *The Theory of the Photographic Process*. These include methods such as ammoniacal emulsion making, neutral or acidic emulsion making, and others known in the art. These methods generally involve mixing a water soluble silver salt with a water soluble halide salt in the presence of a protective colloid, and controlling the temperature, pAg, pH values, etc, at suitable values during formation of the silver halide by precipitation.

The silver halide to be used in the invention may be advantageously subjected to chemical sensitization with noble metal (for example, gold) sensitizers, middle chalcogen (for example, sulfur) sensitizers, reduction sensitizers and others known in the art. Compounds and techniques useful for chemical sensitization of silver halide are known in the art and described in *Research Disclosure I* and the references cited therein.

The photographic elements of the present invention, as is typical, provide the silver halide in the form of an emulsion. Photographic emulsions generally include a vehicle for coating the emulsion as a layer of a photographic element. Useful vehicles include both naturally occurring substances such as proteins, protein derivatives, cellulose derivatives (e.g., cellulose esters), gelatin (e.g., alkali-treated gelatin such as cattle bone or hide gelatin, or acid treated gelatin such as pigskin gelatin), gelatin derivatives (e.g., acetylated gelatin, phthalated gelatin, and the like), and others as described in *Research Disclosure I*. Also useful as vehicles or vehicle extenders are hydrophilic water-permeable colloids. These include synthetic polymeric peptizers, carriers, and/or binders such as poly(vinyl alcohol), poly(vinyl lactams), acrylamide polymers, polyvinyl acetals, polymers of alkyl and sulfoalkyl acrylates and methacrylates, hydrolyzed polyvinyl acetates, polyamides, polyvinyl pyridine, methacrylamide copolymers, and the like, as described in *Research Disclosure I*. The vehicle can be present in the emulsion in any amount useful in photographic emulsions. The emulsion can also include any of the addenda known to be useful in photographic emulsions. These include chemical sensitizers, such as active gelatin, sulfur, selenium, tellurium, gold, platinum, palladium, iridium, osmium, rhenium, phosphorous, or combinations thereof. Chemical sensitization is generally carried out at pAg levels of from 5 to 10, pH levels of from 5 to 8, and temperatures of from 30 to 80° C., as illustrated in *Research Disclosure*, June 1975, item 13452 and U.S. Pat. No. 3,772,031.

The silver halide may be sensitized by sensitizing dyes by any method known in the art, such as described in *Research Disclosure I*. The dye may be added to an emulsion of the silver halide grains and a hydrophilic colloid at any time prior to (e.g., during or after chemical sensitization) or simultaneous with the coating of the emulsion on a photographic element. The dye/silver halide emulsion may be mixed with a dispersion of color image-forming coupler immediately before coating or in advance of coating.

Photographic elements of the present invention can be imagewise exposed using any of the known techniques, including those described in *Research Disclosure I*, section XVI. This typically involves exposure to light in the visible region of the spectrum, and typically such exposure is of a live image through a lens. However, the photographic elements of the present invention may be exposed in a film writer as described above. Exposure in a film writer is an exposure to a stored image (such as a computer stored image) by means of light emitting devices (such as light controlled by light valves, CRT and the like).

Photographic elements comprising the composition of the invention can be processed in any color reversal process. Such processes, as described above, require first treating the element with a black and white developer, followed by fogging non-exposed grains using chemical or light fogging, followed by treatment with a color developer.

Preferred non-chromogenic developers (that is, black and white developers) are hydroquinones (such as hydroquinone sulphonate).

Preferred color developing agents are p-phenylenediamines. Especially preferred are:

4-amino N,N-diethylaniline hydrochloride, 4-amino-3-methyl-N,N-diethylaniline hydrochloride, 4-amino-3-methyl-N-ethyl-N-(β-(methanesulfonamido) ethylaniline sesquisulfate hydrate, 4-amino-3-methyl-N-ethyl-N-(β-hydroxyethyl)aniline sulfate, 4-amino-3-β-(methanesulfonamido)ethyl-N,N-diethylaniline hydrochloride and 4-amino-N-ethyl-N-(2-methoxyethyl)-m-toluidine di-p-toluene sulfonic acid.

Development is followed by bleach-fixing, to remove silver or silver halide, washing and drying. Bleaching and fixing can be performed with any of the materials known to be used for that purpose. Bleach baths generally comprise an aqueous solution of an oxidizing agent such as water soluble salts and complexes of iron (III) (e.g., potassium ferricyanide, ferric chloride, ammonium or potassium salts of ferric ethylenediaminetetraacetic acid), water-soluble persulfates (e.g., potassium, sodium, or ammonium persulfate), water-soluble dichromates (e.g., potassium, sodium, and lithium dichromate), and the like. Fixing baths generally comprise an aqueous solution of compounds that form soluble salts with silver ions, such as sodium thiosulfate, ammonium thiosulfate, potassium thiocyanate, sodium thiocyanate, thiourea, and the like. Further details of bleach and fixing baths can be found in *Research Disclosure I.*

The present invention will be further described in the examples below.

EXAMPLE 1

A cellulose triacetate film support provided with a subbing layer was coated with each layer having the composition set forth below to prepare a multilayer color photographic light-sensitive material, which was designated sample 101.

In the composition of the layers, the coating amounts are shown as g/m$^2$. Silver halide amounts are given in silver amounts.

| | |
|---|---|
| First Layer: Antihalation Layer | |
| Black Colloidal Silver | 0.43 |
| Gelatin | 2.44 |
| Second Layer: Intermediate Layer | |
| Gelatin | 1.22 |
| Third Layer: Non-Imaging Silver Halide Bearing Layer | |
| Silver Iodobromide Emulsion | 0.11 |
| Gelatin | 0.86 |
| Fourth Layer: Intermediate Layer | |
| Competitor-1 | 0.05 |
| Solvent-2 | 0.05 |
| Gelatin | 0.75 |
| Fifth Layer: Slow Red Sensitive layer | |
| Silver Iodobromide Emulsion | 0.64 |
| Cyan coupler C-1 | 0.19 |
| Solvent-2 | 0.09 |
| Gelatin | 0.86 |
| Sixth Layer: Fast Red Sensitive Layer | |
| Silver Iodobromide Emulsion | 0.70 |
| Cyan coupler C-1 | 0.97 |
| Solvent-2 | 0.49 |
| Gelatin | 1.51 |
| Seventh Layer: Intermediate Layer | |
| Competitor-2 | 0.32 |
| Dye-1 | 0.06 |
| Gelatin | 0.70 |
| Eighth Layer: Slow Green Sensitive Layer | |
| Silver Iodobromide Emulsion | 0.59 |
| Coupler M-2 | 0.15 |
| Coupler M-1 | 0.06 |
| Solvent-1 | 0.11 |
| Gelatin | 1.08 |

-continued

| | |
|---|---|
| Ninth Layer: Fast Green Sensitive Layer | |
| Silver Iodobromide Emulsion | 0.66 |
| Coupler M-2 | 0.68 |
| Coupler M-1 | 0.29 |
| Solvent-1 | 0.49 |
| Gelatin | 1.94 |
| Tenth Layer: Yellow Filter Layer | |
| Competitor-2 | 0.32 |
| Dye-2 | 0.27 |
| Gelatin | 0.68 |
| Eleventh Layer: Slow Blue Sensitive Layer | |
| Silver Iodobromide Emulsion | 0.43 |
| Coupler Y-1 | 0.19 |
| Solvent-2 | 0.06 |
| Gelatin | 0.86 |
| Twelfth Layer: Fast Blue Sensitive Layer | |
| Silver Iodobromide Emulsion | 0.60 |
| Coupler Y-1 | 1.56 |
| Solvent-2 | 0.52 |
| Gelatin | 2.37 |
| Thirteenth Layer: First Protective Layer | |
| Competitor-1 | 0.06 |
| Gelatin | 1.40 |
| Ultraviolet Absorbing Dyes | 0.51 |
| Fourteenth Layer: Second Protective Layer | |
| Fine Grain Silver Bromide | 0.12 |
| Matte | 0.02 |
| Bis(vinyl sulfonyl methane) | 0.26 |
| Gelatin | 0.97 |

Comparative samples 102 and 103 were prepared in an identical manner to sample 101 except that 0.12 g/m2 of BAR-1 dispersed with 0.36 g/m2 solvent-3 were added to layer 6 in sample 102 and layer 7 in sample 103. In the sample 104 demonstrating the invention, 0.12 mg/m2 of BAR-1 dispersed with 0.36 g/m2 solvent-3 were added to the non-imaging silver halide bearing layer 3. The samples were stepwise exposed and were processed using standard E-6 processing solutions and methods, with the exception of using a 5% acetic acid stop bath in place of the E-6 prebleach solution. The amounts of silver remaining in the dye Dmin portion of the sensitometrically exposed strip were measured by x-ray fluorescence after processing the strips using 3 minutes and 5 minutes of bleach time. The results are summarized in Table I below.

TABLE I

| Sample | Compound | Layer | Comp/ Inv | Dmin Ag g/m2 3 min bl. | Dmin Ag g/m2 5 min bl. | Red Dmax |
|---|---|---|---|---|---|---|
| 101 | | | comp | 0.146 | 0.066 | 3.26 |
| 102 | BAR-1 | Layer 6 | comp | 0.116 | 0.072 | 2.81 |
| 103 | BAR-1 | Layer 7 | comp | 0.127 | 0.070 | 2.84 |
| 104 | BAR-1 | layer 3 | inv | 0.023 | 0.000 | 3.17 |

As can be seen from the results in Table I, the fastest silver bleaching observed for the dye Dmin areas of the samples occurs in coatings utilizing the structure and compound of the invention. The sample demonstrating the invention also has the least loss of red layer Dmax while achieving the rapid bleaching.

EXAMPLE 2

A cellulose triacetate film support provided with a subbing layer was coated with each layer having the composition set forth below to prepare a multilayer color photographic light-sensitive material, which was designated sample 201.

In the composition of the layer, the coating amounts are shown as g/m2. Silver halide amounts are given in silver amounts.

| | |
|---|---|
| First Layer: Antihalation layer | |
| Black Colloidal Silver | 0.43 |
| Gelatin | 2.44 |
| Second Layer: Intermediate layer | |
| Gelatin | 1.22 |
| Third Layer: Non-imaging Silver Halide Bearing Layer | |
| Silver Iodobromide Emulsion | 0.16 |
| Gelatin | 0.86 |
| Fourth Layer: Intermediate Layer | |
| Competitor-1 | 0.05 |
| Solvent-2 | 0.05 |
| Gelatin | 0.75 |
| Fifth Layer: Slow Red Sensitive Layer | |
| Silver Iodobromide Emulsion layer | 0.47 |
| Cyan coupler C-1 | 0.16 |
| Solvent-2 | 0.09 |
| Gelatin | 1.07 |
| Competitor-2 | 0.02 |
| Sixth Layer: Fast Red Sensitive Layer | |
| Silver Iodobromide Emulsion | 0.90 |
| Cyan coupler C-1 | 1.29 |
| Solvent-2 | 0.65 |
| Gelatin | 2.15 |
| Seventh Layer: Intermediate Layer | |
| Competitor-2 | 0.32 |
| Dye-1 | 0.06 |
| Gelatin | 0.61 |
| Eighth Layer: Slow Green Sensitive Layer | |
| Silver Iodobromide Emulsion | 0.59 |
| Coupler M-2 | 0.11 |
| Coupler M-1 | 0.05 |
| Solvent-1 | 0.08 |
| Gelatin | 0.86 |
| Ninth Layer: Fast Green Sensitive Layer | |
| Silver Iodobromide Emulsion | 0.70 |
| Coupler M-2 | 0.68 |
| Coupler M-1 | 0.29 |
| Solvent-1 | 0.49 |
| Gelatin | 1.94 |
| Tenth Layer: Yellow Filter Layer | |
| Competitor-2 | 0.32 |
| Dye-2 | 0.27 |
| Gelatin | 0.61 |

-continued

| | |
|---|---|
| Eleventh Layer: Slow Blue Sensitive Layer | |
| Silver Iodobromide Emulsion | 0.32 |
| Coupler Y-1 | 0.32 |
| Solvent-2 | 0.10 |
| Gelatin | 0.86 |
| Twelfth Layer: Fast Blue Sensitive Layer | |
| Silver Iodobromide Emulsion | 0.48 |
| Coupler Y-1 | 1.56 |
| Solvent-2 | 0.52 |
| Gelatin | 2.37 |
| Thirteenth Layer: First Protective Layer | |
| Competitor-1 | 0.06 |
| Gelatin | 1.40 |
| Ultraviolet Absorbing Dyes | 0.51 |
| Fourteenth Layer: Second Protective Layer | |
| Fine Grain Silver Bromide | 0.12 |
| Matte | 0.02 |
| Bis(vinyl sulfonyl methane) | 0.26 |
| Gelatin | 0.97 |

Comparative sample 202 was prepared in an identical manner to sample 201 except that 0.15 g/m2 of BAR-2 dispersed with 0.30 g/m2 solvent-3 were added to layer 7. In the sample 203 demonstrating the invention, 0.15 g/m2 of BAR-2 dispersed with 0.30 g/m2 solvent-3 were added to the non-imaging silver halide bearing layer 3. The samples were stepwise exposed and were processed using standard E-6 processing solutions and methods, with the exception of using a 5% acetic acid stop bath in place of the E-6 prebleach solution. The amounts of silver remaining in the dye Dmin portion of the sensimetrically exposed strip were measured by x-ray fluorescence after processing the strips using 3 minutes and 5 minutes of bleach time.

TABLE II

| Sample | Compound | Layer | Comp/Inv | Dmin Ag g/m2 3 min bl. | Dmin Ag g/m2 5 min bl. |
|---|---|---|---|---|---|
| 201 | | | comp | 0.179 | 0.121 |
| 202 | BAR-2 | Layer 7 | comp | 0.089 | 0.068 |
| 203 | BAR-2 | Layer 3 | inv | 0.021 | 0.029 |

As in example 1, the results in Table II show the fastest silver bleaching observed for the dye Dmin areas of the samples occurs in coatings utilizing the structure and compound of the invention.

Structures of compounds used in Examples 1 and 2 are given below:

| | |
|---|---|
| Solvent-1: | tritolyl phosphates |
| Solvent-2: | dibutyl phthalate |
| Solvent-3: | N,N-diethyl lauramide |

-continued
Competetitor-1:
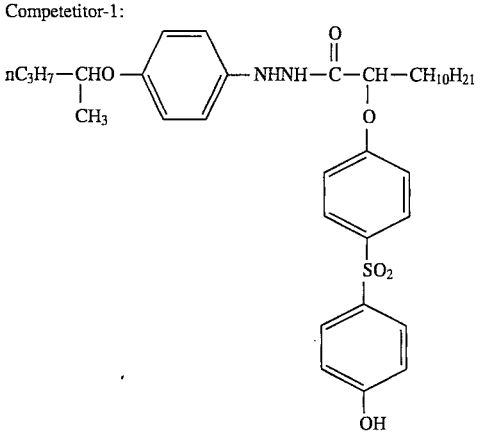
Competetitior 2:
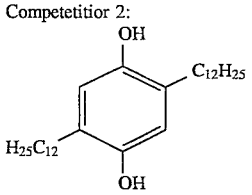
Dye-1:
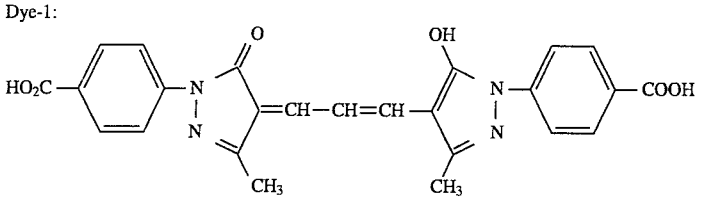
Dye-2:
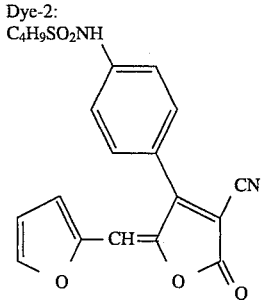
Magenta Dye-Forming Coupler M-1:
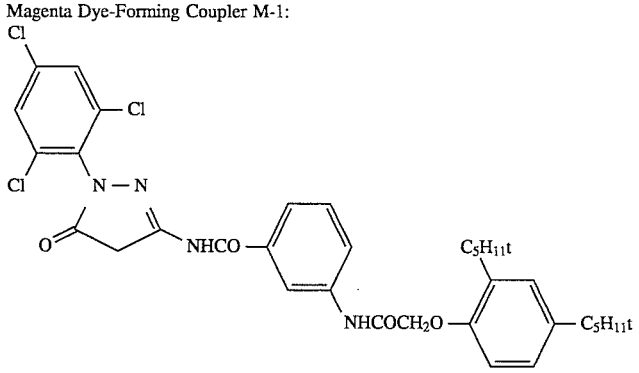

-continued

Magenta Dye-Forming Coupler M-2:

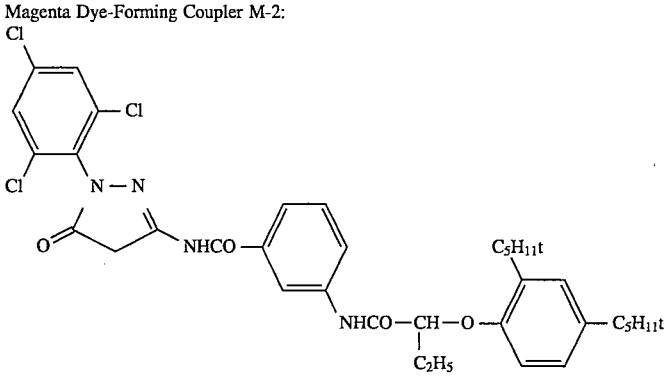

Cyan Dye-Forming Coupler C-1:

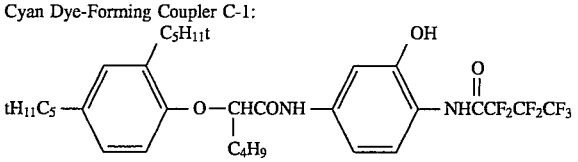

Yellow Dye-Forming Coupler Y-1:

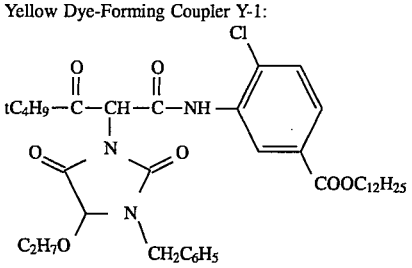

The preceding examples are set forth to illustrate specific embodiments of this invention and are not intended to limit the scope of the compositions or materials of the invention. It will be understood that variations and modifications can be effected within the spirit and scope of the invention.

I claim:

1. A color reversal silver halide photographic element comprising a light sensitive silver halide emulsion layer, and a second layer containing a light insensitive silver halide emulsion, said element additionally comprising a bleach accelerating releasing compound in the second layer or in a layer associated therewith; wherein the light insensitive layer is located so that upon processing no substantial amount of oxidized color developer will diffuse from the light insensitive layer to a light sensitive silver halide imaging layer containing permanent image dye forming coupler.

2. A color reversal element according to claim 1 wherein the bleach accelerating releasing compound is a coupler compound which releases a bleach accelerator upon coupling with oxidized aromatic amine developer.

3. A color reversal element according to claim 2 wherein the bleach accelerating releasing compound forms a colorless compound upon coupling with oxidized aromatic amine developer.

4. A color reversal element according to claim 2 wherein the bleach accelerating releasing coupler, upon coupling with oxidized aromatic amine developer, yields a compound at least 75% of which is removed during standard reversal processing.

5. A color reversal element according to claim 1 wherein the bleach accelerating releasing compound is a compound which releases a bleach accelerator upon a redox reaction with an oxidized aromatic amine developer.

6. A color reversal element according to claim 5 wherein the bleach accelerating releasing compound comprises a hydrazide which releases a bleach accelerator upon a redox reaction with an oxidized aromatic developer.

7. A method of processing a color reversal element according to claim 1, the method comprising contacting the element with a non-chromogenic developer to develop exposed silver halide, then fogging unexposed silver halide, then contacting the element with a color developer.

8. A method of processing a color reversal element according to claim 2, the method comprising contacting the element with a non-chromogenic developer to develop exposed silver halide, then fogging unexposed silver halide, then contacting the element with a color developer.

9. A method of processing a color reversal element according to claim 5, the method comprising contacting the element with a non-chromogenic developer to develop exposed silver halide, then fogging unexposed silver halide, then contacting the element with a color developer, the processing removing at least 75% of the compound formed between the bleach accelerating releasing compound and oxidized color developer.

10. A color reversal silver halide photographic element comprising a support, at least one light sensitive silver halide emulsion, a second layer positioned beneath all light sensitive silver halide emulsion layers and which second layer contains a light insensitive silver halide emulsion, said element additionally comprising a bleach accelerating releasing compound in the second layer or in a layer associated with the second layer; wherein the light insensitive layer is located so that upon processing no substantial amount of oxidized color developer will diffuse from the light insensitive layer to a light sensitive silver halide imaging layer containing permanent image dye forming coupler.

11. A color reversal element according to claim 10 wherein the bleach accelerating releasing compound is located in the second layer or a layer above the second layer.

12. A color reversal element according to claim 11 wherein the bleach accelerating releasing compound is located in the second layer.

13. A method of processing a color reversal element according to claim 11, the method comprising contacting the element with a non-chromogenic developer to develop exposed silver halide, then fogging unexposed silver halide, then contacting the element with a color developer.

14. A method of processing a color reversal element according to claim 10, the method comprising contacting the element with a non-chromogenic developer to develop exposed silver halide, then fogging unexposed silver halide, then contacting the element with a color developer.

* * * * *